United States Patent [19]

Stahl et al.

[11] 4,426,001

[45] Jan. 17, 1984

[54] NESTABLE AND STACKABLE CONTAINER

[75] Inventors: Edward L. Stahl, Brighton Township, Livingston County; Elsmer W. Kreeger, Allegan Township, Allegan County, both of Mich.

[73] Assignee: Pinckney Molded Plastics, Inc., Pinckney, Mich.

[21] Appl. No.: 302,075

[22] Filed: Sep. 14, 1981

[51] Int. Cl.[3] ..... B65D 21/04

[52] U.S. Cl. ..... 206/507; 206/505

[58] Field of Search ..... 206/505, 506, 507

[56] References Cited

U.S. PATENT DOCUMENTS

| | | | |
|---|---|---|---|
| 3,420,402 | 1/1969 | Frater | 206/507 |
| 3,773,213 | 11/1973 | Frederick | 206/507 |
| 3,780,905 | 12/1973 | Herolzer | 206/507 |
| 3,825,114 | 7/1974 | Johnson | 206/507 |
| 4,205,749 | 6/1980 | Carroll | 206/507 |

FOREIGN PATENT DOCUMENTS

| | | | |
|---|---|---|---|
| 167115 | 5/1959 | Sweden | 206/507 |

*Primary Examiner*—George E. Lowrance

*Attorney, Agent, or Firm*—Barnes, Kisselle, Raisch, Choate, Whittemore & Hulbert

[57] ABSTRACT

A square nesting and stacking container wherein each wall of the container has a plurality of feet near the bottom of the container and a plurality of saddles near the top of the container. The saddles are located directly above the feet so that the feet will engage the saddles of a similarly oriented container of identical construction and support the same in a stacked relationship. There are clearances between the saddles so that when one container is turned 90° with respect to another, it may be lowered into a nested relationship with the latter without interference because the feet will enter and pass through the clearances of the lower container.

5 Claims, 11 Drawing Figures

NESTABLE AND STACKABLE CONTAINER

This invention relates generally to containers and refers more particularly to a container which will either stack or nest with a second container of identical construction.

SUMMARY OF THE INVENTION

The container of this invention has a square bottom and side and end walls projecting upwardly from the bottom. Each of the walls has a lower section and an upper section spaced outwardly from the lower section sufficiently to permit the container to nest with a second container of identical construction.

In accordance with the specific construction about to be described, each wall of the container has a plurality of feet spaced from one another along the outer side of the lower section thereof. Each wall also has a plurality of saddles spaced from one another along the inner side of the upper section thereof. The saddles are located directly above the feet so that the feet will engage the saddles of a similarly oriented lower container of identical construction and support the same in a stacked relationship.

Each wall of the container has clearances laterally offset from the saddles along the inner side of the upper section. The clearances are arranged so that when a container is turned 90° with respect to a lower container of identical construction, it may be lowered into a nested relationship therewith without interference because the feet will enter and pass through the clearance of the lower container.

The container may be slid across the top of a lower container of identical construction to a stacked position, or even to a nested position, although the slide-on feature is used primarily for stacking. Certain of the feet and saddles are utilized for sliding on.

Other objects and features of this invention will become more apparent as this description proceeds, especially when considered with the accompanying drawings.

DETAILED DESCRIPTION

Figure 1:
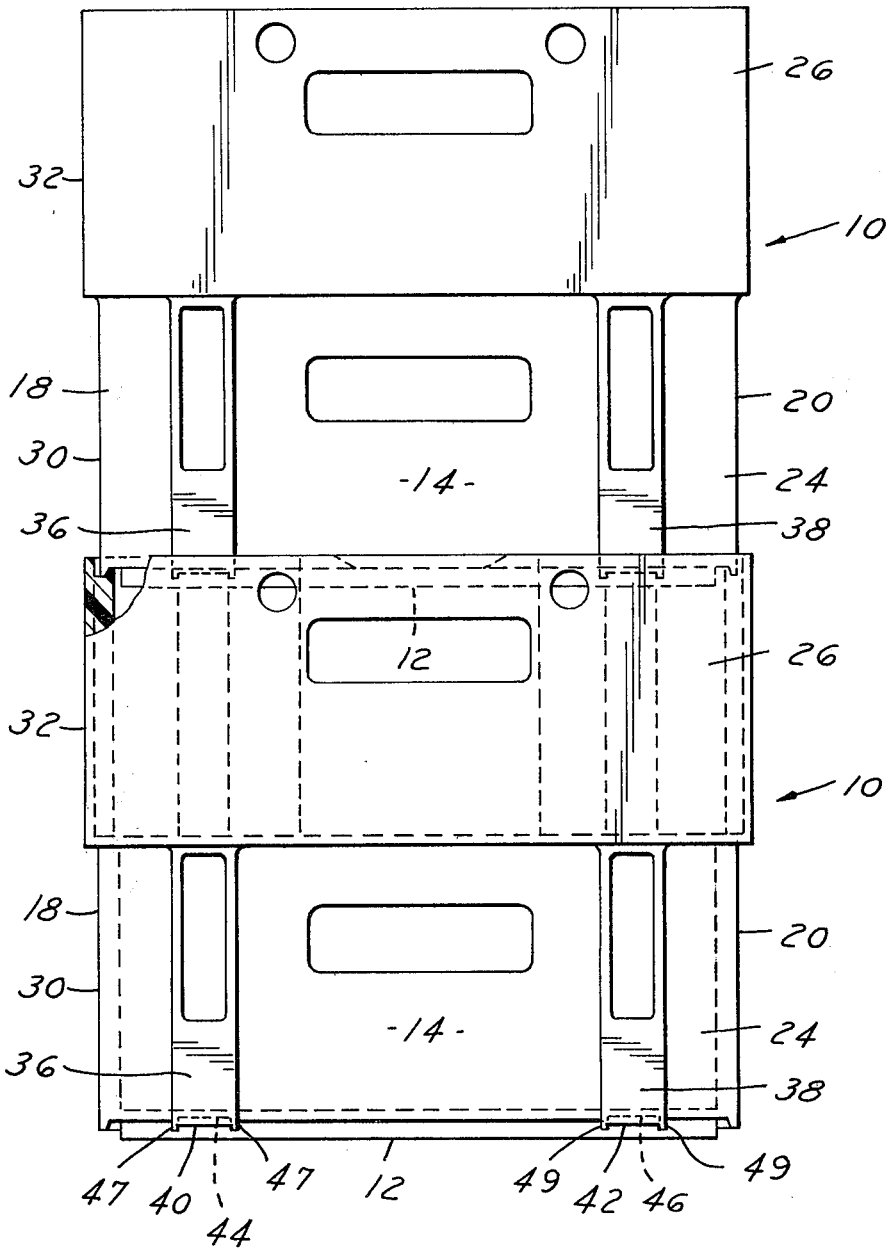
FIG. 1 is a side elevational view with parts in section showing two identical containers of this invention stacked one upon the other.

Referring now more particularly to the drawings, the container there shown is preferably of one-piece molded construction formed of a suitable plastic material such as polyethylene or polypropylene. The container is generally designated by the reference numeral 10 and is shown in some of the views with a second container of identical construction.

The container 10 has a horizontal rectangular bottom wall 12, side walls 14 and 16 and end walls 18 and 20. The bottom 12 may be of any suitable construction. Its main surface area is shown as having a grid-like configuration which is desirable from the standpoint of weight reduction and ease with which it may be cleaned.

The walls 14 and 16 are referred to as "side walls" and the walls 18 and 20 are referred to as "end walls" merely for the sake of convenience since they are of somewhat different construction as will be apparent from the description to follow. However, the side and end walls are of the same width because the bottom is square.

The side walls 14 and 16 are identical to one another. The end walls 18 and 20 are identical to one another although of somewhat different construction from the side walls. Each side wall extends vertically upwardly from the side edges of the bottom 12 and has a lower vertical section 24 and an upper vertical section 26 spaced laterally outwardly from the lower section and joined thereto by a generally horizontal ledge 28. Each end wall extends vertically upwardly from the end edges of the bottom 12 and has a lower vertical section 30 and an upper vertical section 32 spaced laterally outwardly from the lower section and joined thereto by a generally horizontal ledge 34. The ledges 28 and 34 lie in a common horizontal plane and connect end to end at the corners of the container. The upper sections of the side and end walls are spaced outwardly from the lower sections thereof a distance sufficient to permit nesting and also to clear the stacking strips which are more fully described hereinafter.

Figure 2:
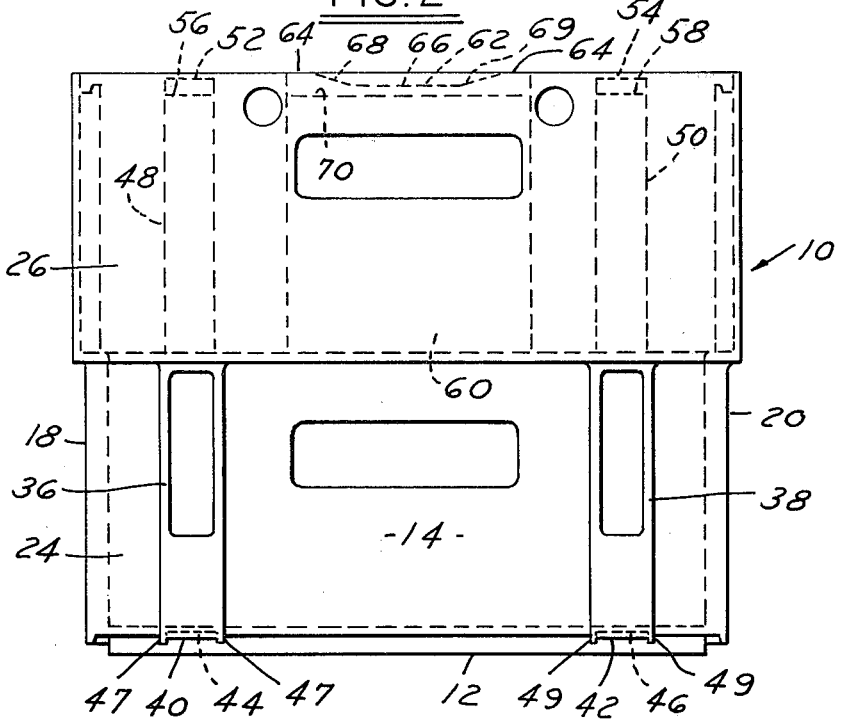
FIG. 2 is a side elevational view of the container.
Figure 5:
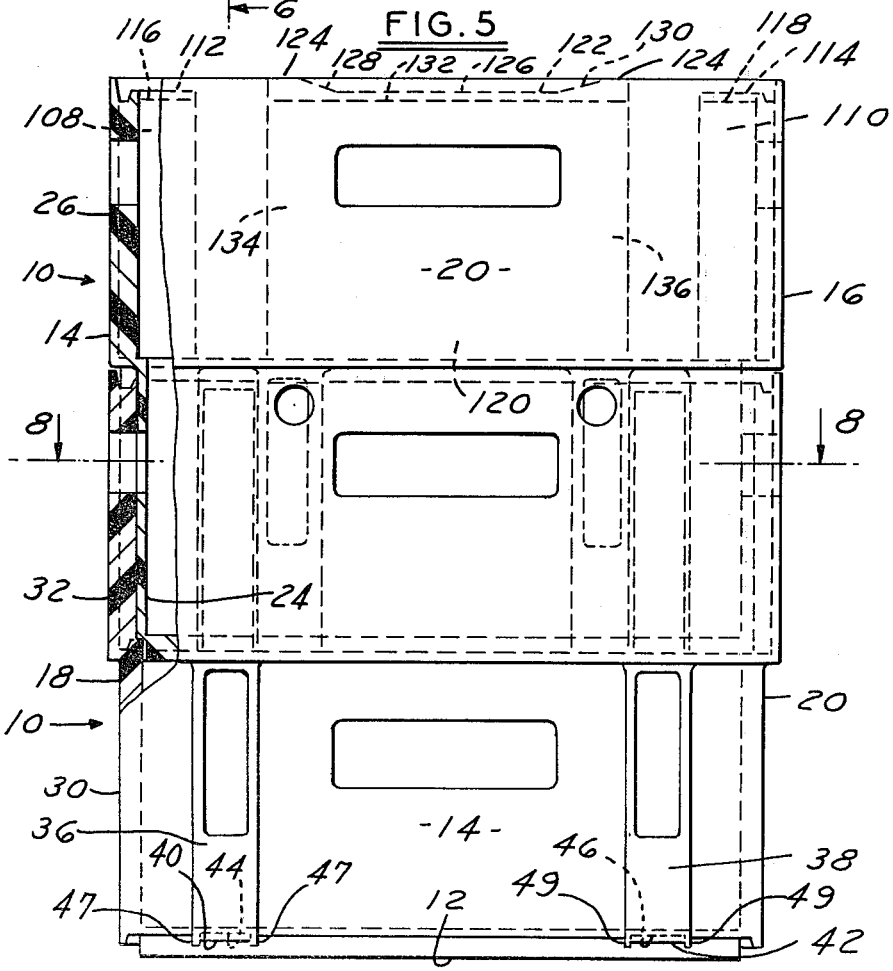
FIG. 5 is a view partially in elevation and partly in section taken on the line 5—5 in FIG. 4, showing two nested containers.

Referring to FIGS. 1, 2 and 5, each of the side walls 14 and 16 has a pair of laterally spaced, elongated, vertical, rectangular lower stacking strips 36 and 38 on the outer side of the lower section 24 thereof. Strips 36 and 38 are identical. They extend from the ledge 28 down to a point slightly above the bottom of the container, terminating at the lower ends in flanges 40 and 42 which have aligned horizontal recesses in their lower edges as shown. Between the flanges and the side wall proper, the strips are recessed where indicated at 44 and 46. The recesses 44 and 46 are horizontal and closed at the ends by right angle extensions 47 and 49 of the flanges 40 and 42 which turn inwardly and merge into the side wall proper. The recessses, in particular the horizontal top surfaces thereof, are supporting feet for the container. These feet are horizontally aligned. The strips are symmetrically arranged on each side wall by being spaced equal distances from the vertical center line of the side wall on opposite sides thereof and are preferably formed integrally with the side wall.

Each of the side walls 14 and 16 has a pair of laterally spaced, elongated, vertical, rectangular upper stacking strips 48 and 50 on the inner side of the upper section 26 thereof. The strips 48 and 50 are identical. They extend from the ledge 28 up to a point slightly below the upper edge of the container, terminating at the upper ends in aligned horizontal saddles or flanges 52 and 54. Between the saddles 52 and 54 and the side wall proper, the strips have open-ended recesses 56 and 58. The upper strips 48 and 50 are located directly above the lower strips 36 and 38 and accordingly the saddles 52 and 54 are respectively located directly above the feet 44 and 46. The upper strips 48 and 50 are slightly narrower than the lower strips 36 and 38 and the recesses or feet 44, 46 are sufficiently wider than the saddles 52, 54 that the saddles of a lower container will be received in the recesses or feet 44, 46 of a similarly oriented upper container of identical construction for stacking with the flanges 40 and 42 of strips 36 and 38 extending into recesses 56 and 58 of the strips 48 and 50 and the flange extensions 47 and 49 confining the ends of saddles 52 and 54 and preventing lateral movement between the feet and saddles. Strips 48 and 50 are preferably formed integrally with the side wall.

Figure 4:
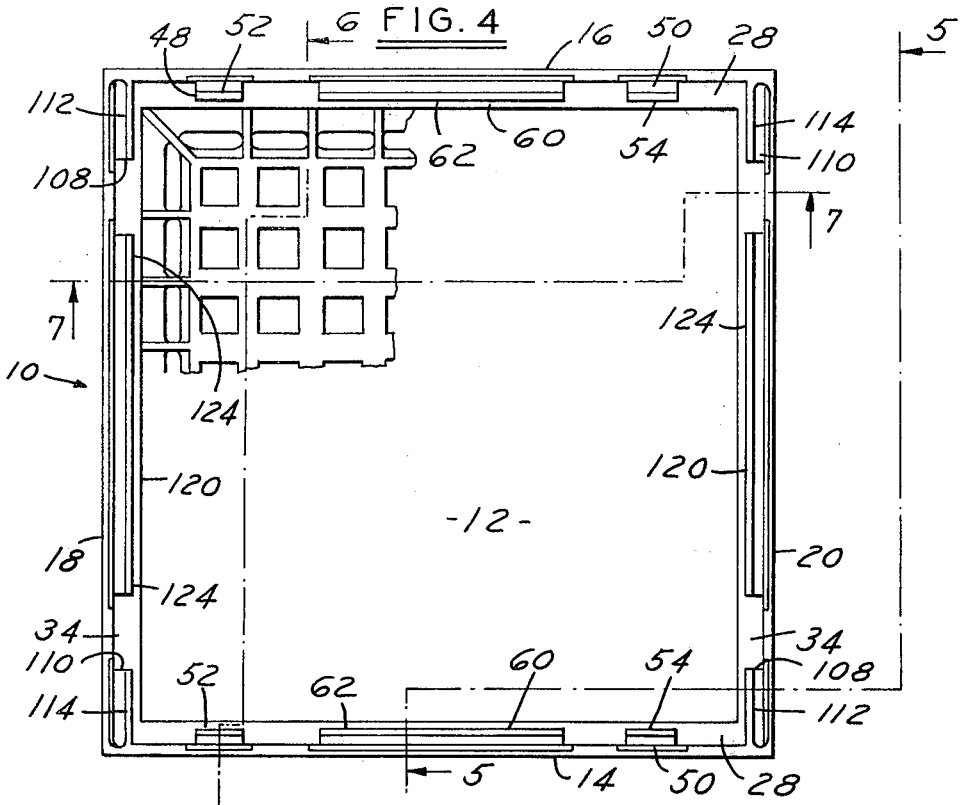
FIG. 4 is a top plan view.
Figure 7:
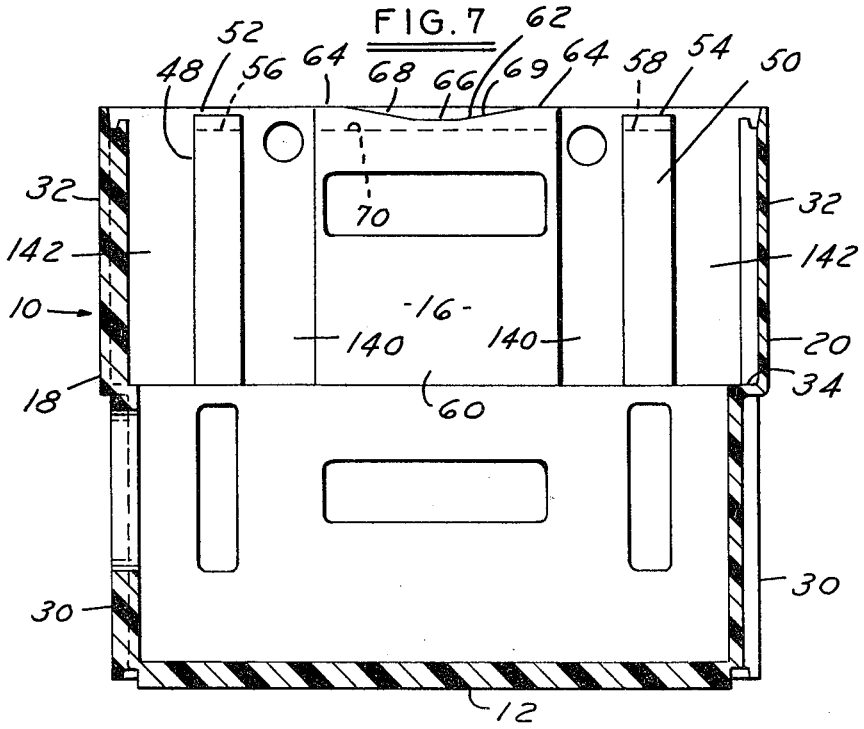
FIG. 7 is a sectional view taken on the line 7—7 in FIG. 4.
Figure 8:
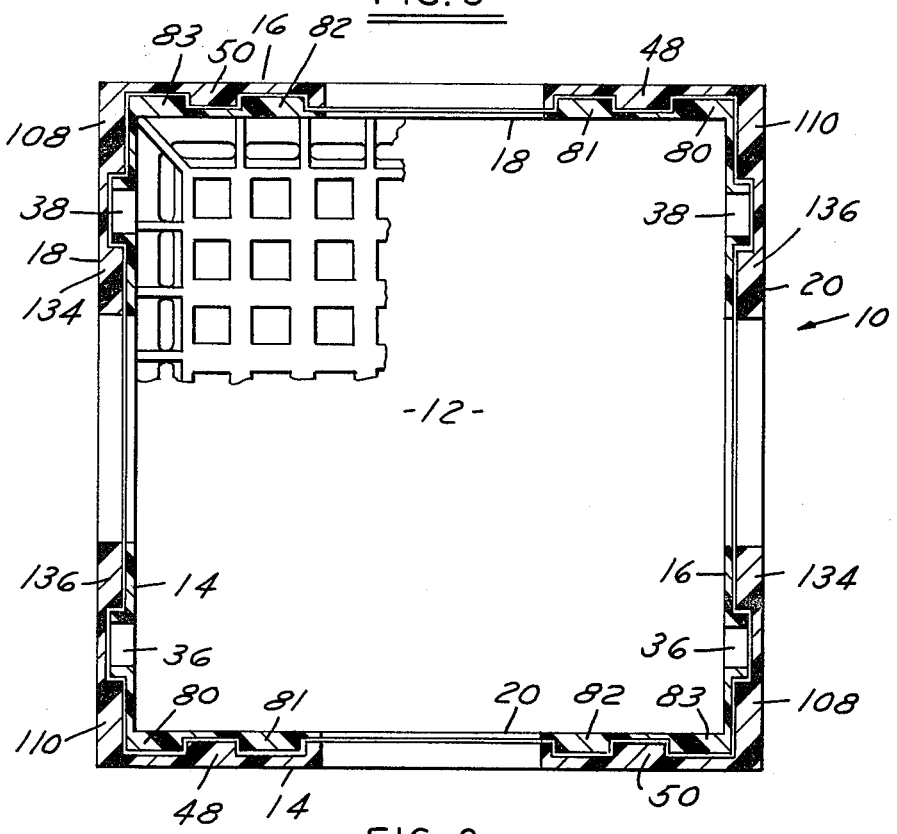
FIG. 8 is a sectional view taken on the line 8—8 in FIG. 5.

Each of the side walls 14 and 16 has a relatively wide central strip 60 on the inner side of the upper section 26 thereof. The central strip 60 extends from the ledge 28 up to approximately the level of the top edge of the side wall, terminating at its upper end in a flange 62. Flange 62 is aligned with saddles 52 and 54 when viewed from the top (FIG. 4) although not at the same height as seen in FIGS. 2 and 7. The laterally outer horizontal top edge portions 64 of the flange 62 are disposed at the level of the top edge of the side wall, while the horizontal central portion 66 thereof is disposed at a slightly lower level beneath saddles 52 and 54 and is joined to the laterally outer portions by inclined portions 68 and 69. The central strip between the flange 62 and the side wall proper is recessed along a horizontal line where indicated at 70 at approximately the same level as the horizontal recesses 56 and 58. The central strip is rectangular except for the portions 66, 68 and 69 of the top edge thereof, and is preferably formed integrally with the side wall. The central strip together with the saddles cooperate with the feet to serve as a means to permit lateral slide-on of an upper container relative to a lower container particularly for stacking but also for nesting, as will become more apparent hereinafter.

Figure 3:
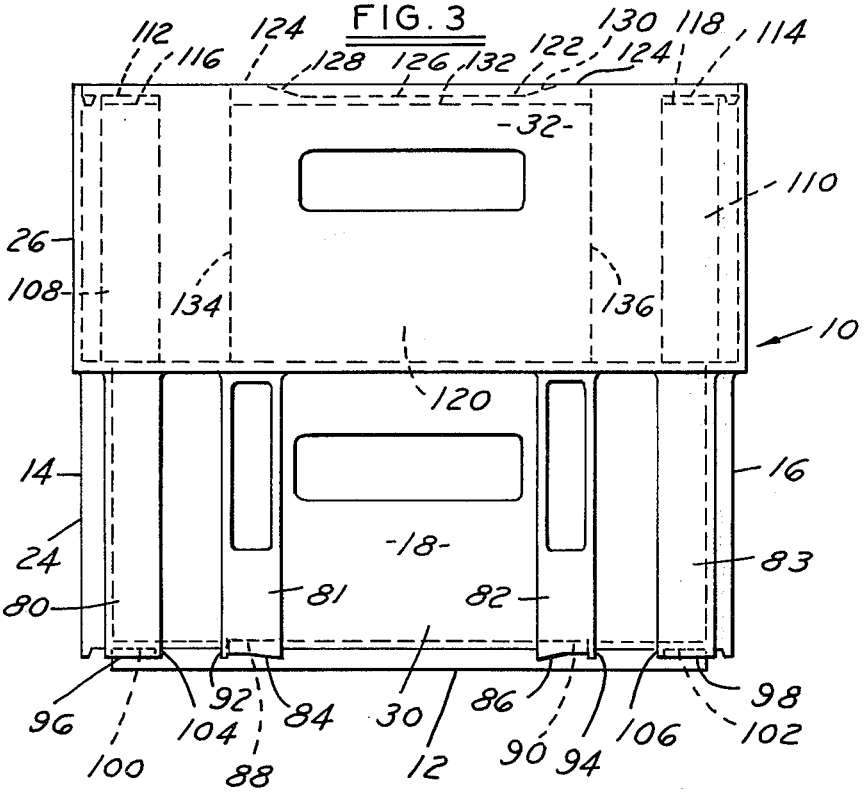
FIG. 3 is an end elevational view of the container.
Figure 6:
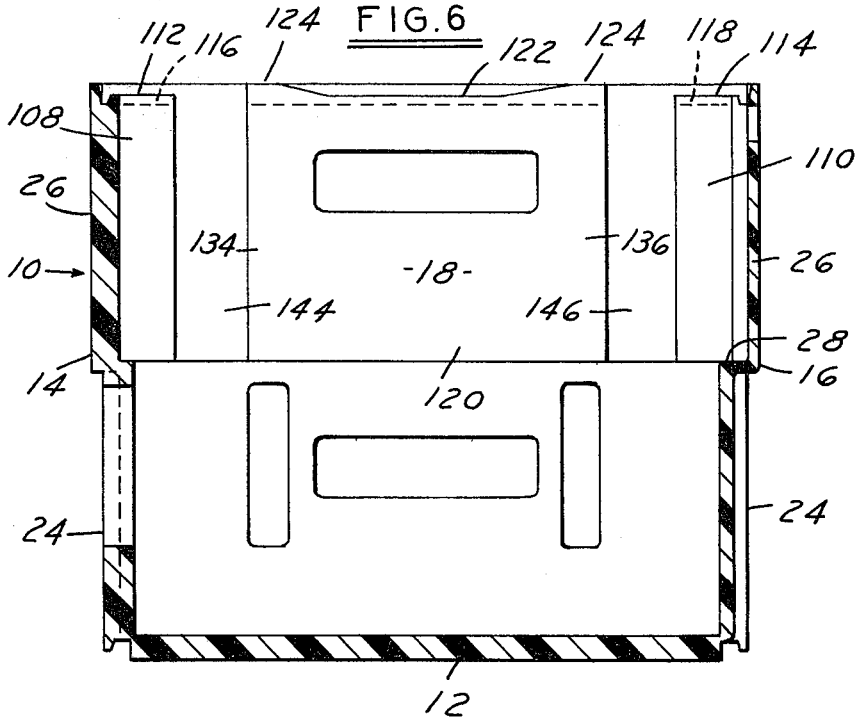
FIG. 6 is a sectional view taken on the line 6—6 in FIG. 4.

Referring to FIGS. 3 and 6, each of the end walls 18 and 20 has two pairs of laterally spaced elongated, vertical rectangular lower stacking strips 80, 81, 82 and 83 on the outer side of the lower section 30 thereof. These strips, which are preferably integral with the container end walls, extend from the ledge 34 down to a point slightly above the bottom of the container. The strips 80 and 81 are disposed on one side of the vertical center line of each end wall and the strips 82 and 83 are disposed on the opposite side of the vertical center line, with the innermost strips 81 and 82 spaced from the center line an equal distance and with the outermost strips 80 and 83 spaced from the innermost strips an equal distance so that the arrangement of strips 80-83 on each side wall is symmetrical with respect to the vertical centerline.

The innermost strips 81 and 82 are mirror images of one another and terminate at their lower ends in flanges 84 and 86. Between the flanges and the end wall proper, the strips 81 and 82 are recessed where indicated at 88 and 90. The recesses 88 and 90 are aligned horizontally, and are open at their laterally inner ends but closed at their laterally outer ends by right angle extensions 92 and 94 of flanges 84 and 86 which turn inwardly and merge into the end wall proper. The recesses, in particular the aligned horizontal top surfaces thereof, are supporting feet for the container. The lower edges of the flanges 84 and 86 have the recessed configuration shown in FIG. 3, being sloped upwardly from the inner extremities, and then extending horizontally to the right angle extensions 92 and 94 of the flanges.

The outermost strips 80 and 83 are mirror images of one another and terminate at their lower ends in flanges 96 and 98. Between the flanges and the end wall proper, the strips 80 and 83 are recessed as indicated at 100 and 102. The recesses are aligned horizontally and are open at their laterally outer ends but closed at their laterally inner ends by right angle extensions 104 and 106 which turn inwardly and merge into the end wall proper. The recesses 100 and 102, in particular the aligned horizontal top surfaces thereof, are supporting feet for the container and are at a lower level than feet 88 and 90 of strips 81 and 82 although aligned therewith when viewed from above.

Each of the end walls 18 and 20 has a pair of laterally spaced elongated, vertical, rectangular upper stacking strips 108 and 110 on the inner side of the upper section 32 thereof. These strips are identical and extend from the ledge 34 up to a point slightly below the upper edge of the container, terminating at their upper ends in horizontally aligned saddles or flanges 112 and 114. Between the saddles 112 and 114 and the end wall proper, the strips have recesses 116 and 118 which are closed at the outer ends and open at the inner ends. The upper strips 108 and 110 are located directly above the lower strips 80 and 83 and accordingly the saddles 112 and 114 are respectively located directly above the feet 100 and 102.

Each of the end walls 18 and 20 has a relatively wide central strip 120 on the inner side of the upper section 32 thereof. The central strip 120 extends from the ledge 34 up to approximately the level of the top edge of the end wall, terminating at its upper edge in a flange 122 which is aligned with saddles 112 and 114 when viewed from above (FIG. 4) although not at the same height as seen in FIGS. 3 and 6. The laterally outer horizontal top edge portions 124 of the flange 122 are disposed at the level of the top edge of the end wall, while the horizontal central portion 126 thereof is disposed at a slightly lower level beneath saddles 112 and 114 and is joined to the outer portions by inclined portions 128 and 130. The central strip between the flange 122 and the end wall proper is recessed along a horizontal line indicated at 132 at approximately the same level as the horizontal recesses. The central strip 108 is rectangular except for the portions 126, 128 and 130 of its top edge. The central strip and the stacking strips 108 and 110 of each end wall are preferably formed integrally therewith.

The laterally outer portions of the central strip 120 of each end wall, that is those portions directly above the lower strips 81 and 82, are the equivalent of upper stacking strips which are designated 134 and 136 and their flange portions 124 serve as aligned saddles positioned directly above the feet 88 and 90 of strips 81 and 82. Saddles 124 are at a level above saddles 112 and 114 by an amount equal to the difference in level between feet 100, 102 and feet 88, 90.

Figure 10:
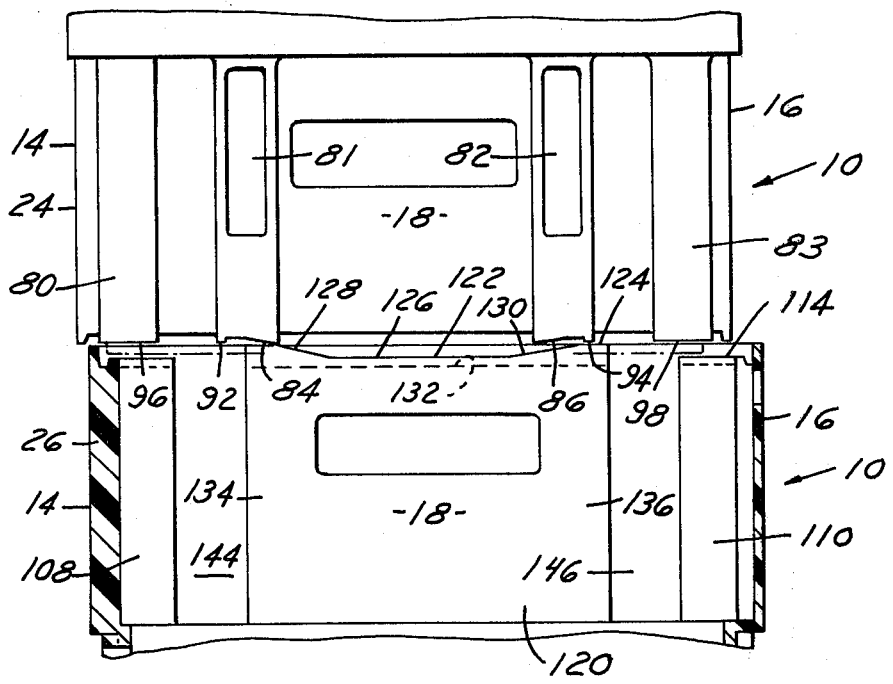
FIG. 10 is a view showing the container being slid laterally towards a stacked position with respect to a similarly oriented lower container of identical construction.

Referring to FIGS. 6 and 10, there is a rectangular space or clearance 144 between the upper stacking strips 108 and 134 of each end wall 18, 20 and a rectangular space or clearance 146 between the upper stacking strips 110 and 136. Clearances 144 and 146 are slightly wider than the lower stacking strips 36 and 38 of side walls 14 and 16. During nesting of two containers, with one turned 90° relative to the other, strips 36 and 38 are received in the clearance 144 and 146.

Figure 9:
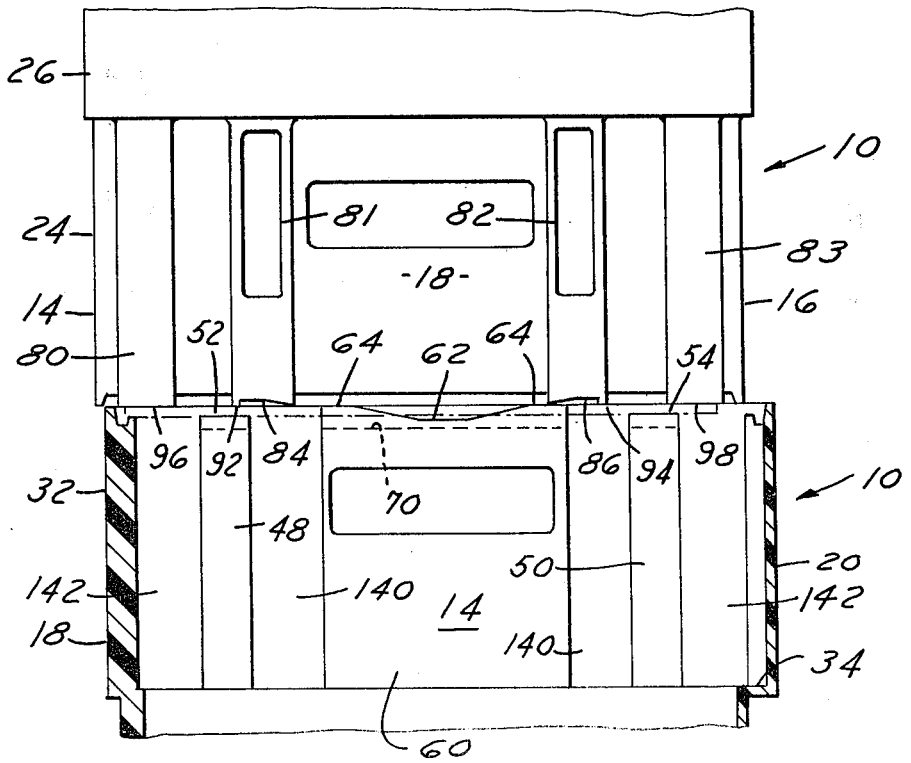
FIG. 9 is a view showing the container of this invention being slid laterally towards a position in which it may be lowered to a nested relationship with respect to a 90° turned lower container of identical construction.
Figure 11:
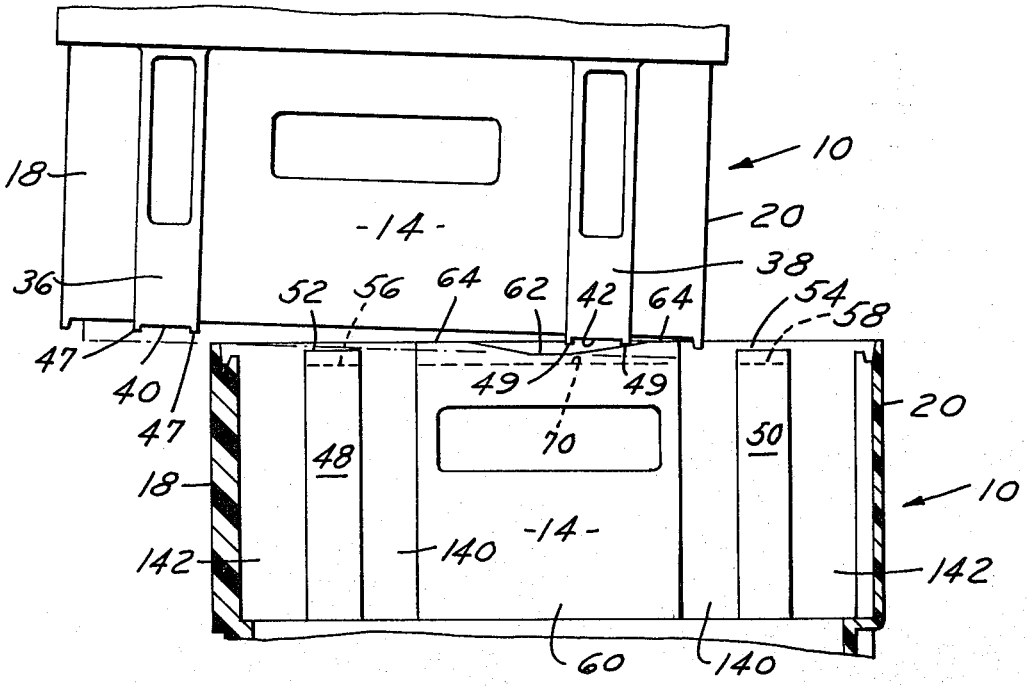
FIG. 11 is similar to FIG. 10 but shows the relationship of the two containers as viewed from a different side.

Referring now to FIGS. 7, 9 and 11, there are rectangular spaces or clearances 140 between the central strip 60 and the upper stacking strips 48 and 50 of side walls 14 and 16 and rectangular spaces or clearances 142 between strips 48, 50 and the corners of the container. These clearances extend from the saddles 52, 54 down to the ledge 28. Clearances 140 are slightly wider than the lower stacking strips 81 and 82 of end walls 18 and 20 and clearances 142 are slightly wider than lower stacking strips 80 and 83. During nesting of two containers, with one turned 90° relative to the other, strips 80 and 83 are received in clearances 142 and strips 81 and 82 are received in clearances 140.

In order to stack two of the containers 10, one such container is positioned directly above another similarly oriented container and then lowered until the feet of the upper container come to rest upon the saddles of the lower container. By similarly oriented is meant that the side and end walls of the upper container are respectively directly above the side and the end walls of the lower container (side wall 14 of the upper above either side wall 14 or 16 of the lower and end wall 18 of the upper above either end wall 18 or 20 of the lower). Feet 44 and 46 come to rest on respective saddles 52 and 54 with the foot flanges 40 and 42 extending into recesses 56 and 58 and with flange extensions 47 and 49 embracing the ends of the saddles to restrict relative lateral movement. Feet 100, 88, 90 and 102 come to rest on saddles 112, 124, 124 and 114 respectively with the foot flanges 96, 84, 86 and 98 extending into recesses 116, 132, 132 and 118 respectively and flange extensions 104, 92, 94 and 106 extending across the ends of the saddles to restrict relative lateral movement. All of the saddles and all feet are at levels such that one container will stack square on another.

The two similarly oriented containers may be slid to a stacked position in the manner shown in FIG. 10 or in the manner shown in FIG. 11. In FIG. 10, the upper container is slid across the top of the lower container in a direction toward one of the side walls 14, 16. One of the foot flange extensions (94 in FIG. 10, but 92 if slid in the opposite direction) of each end wall engages the top edge of flange 122 of central strip 120 (flange 122 acting as a rail and the foot flange extension acting as a rail follower) and will guide the upper container across flange portions 126, 130 and 124 to a stacked position directly over the lower container with its feet supported on the saddles of the latter as described above. During this movement, the engagement of the foot flange extension 94 with the flange 122 will support the upper container so that the foot 102 will not fall into the clearance 146.

In FIG. 11, the upper container is slid across the top of the lower container in a direction toward one of the end walls. One of the foot flange extensions (49 in FIG. 11, but 47 if slid in the opposite direction) of each side wall, acting as a rail follower, engages the top edge of the flange or rail 62 of central strip 60 and will guide the upper container to a stacked position. During this movement, and because the strips 36 and 38 are wider than the clearance 140, the foot 46 will bridge over the clearance without falling in, being supported first by one flange extension 49 engaging flange 62 of the central strip and than by the other flange extension 49 engaging saddles 54. Flange extension 49 may also slide over saddle 54 in the final stages of movement.

In order to nest two of the containers 10, one such container is positioned directly above another container turned 90° with respect to the upper container so that the side walls of the upper container are above the end walls of the lower container and the end walls of the upper are above the side walls of the lower. The upper container is then lowered. The lower stacking strips 36 and 38 of the side walls of the upper container pass down into the clearance 144 and 146 of the end walls of the lower container, and the lower stacking strips 80–83 of the end walls of the upper container pass down into the clearances 140 and 142 of the side walls of the lower container with the feet of the upper container ultimately coming to rest on the ledges 28 and 34 of the lower container.

The upper container in FIG. 9 is turned 90° relative to the lower container and is shown sliding to a nested position in a direction toward one of its side walls. One of the foot flange extensions (94 in FIG. 9, but 92 if slid in the opposite direction) of each end wall engages the top edge of flange 62 of central strip 60 and guides the upper container until the foot flange extension 94 drops off the end of the flange 62, whereupon sliding movement continues with the recess 90 engaging the flange 62 until the upper container is aligned directly over the lower container and drops into the nested position. The two dissimilarly oriented containers may be slid into a nested position by sliding the upper container across the top of the lower container in a direction at right angles to that shown in FIG. 9, that is in a direction toward one of its end walls. In that case, the foot flange extensions 47 or 49, depending upon the direction of movement, will engage the top flange 122 of the central strip 120 and will guide the sliding movement of the upper container until the aligned position is reached directly over the lower container whereupon the upper container will drop into a fully nested position.

The slide-one feature of this invention does not require additional feet at the bottom of the container, nor an added rail or rails at the top spaced inwardly of the saddles, as other containers do. The stacking feet and saddles of the container of this invention, or some of them, are involved in the sliding on of an upper container. While a rail at the top between saddles is also utilized, it is not spaced inwardly of the saddles and, therefore, does not reduce the usable inside space of the container.

We claim:

1. A nesting and stacking container comprising a square bottom, side walls projecting upwardly from the opposite side edges of said bottom, end walls projecting upwardly from the opposite end edges of said bottom, each wall of said container having a plurality of feet spaced from one another along the lower edge portion thereof, each wall of said container having a plurality of saddles spaced from one another along the upper edge portion thereof, the saddles of each wall being located directly above the feet thereof so that the feet of said container will engage the saddles of a similarly oriented, lower container of identical construction and support the same in a stacked relationship, each wall of said container having a plurality of spaced clearances laterally offset from the saddles thereof, the width of the clearances of the side walls exceeding the width of the feet of the end walls and the width of the clearances of the end walls exceeding the width of the feet of the side walls, the spacing and lateral placement of the saddles of said end walls corresponding to the spacing and lateral placement of the clearances of said side walls, the spacing and lateral placement of the saddles of said side walls corresponding to the spacing and lateral placement of the clearances of said end walls, whereby when said container is turned 90° with respect to a lower container of identical construction it may be lowered into a nested relationship therewith without interference because the feet thereof will enter and pass through the clearances of the lower container, elongated, generally horizontal rails along each wall in general horizontal alignment with the saddles thereof, said saddles constituting horizontal extensions of said rails, and downwardly extending rail followers on certain of the feet on each said wall, said rail followers being adapted to engage the rails of a similarly oriented lower container of identical construction to facilitate sliding thereof to a stacked position, said feet, rails and clearances on each wall being of such dimension and location that when said container is being slid to a stacked position on a similarly oriented lower container of identical construction said feet will be supported by said rails and bridge over said clearances.

2. A container as defined in claim 1, wherein said saddles and said feet are defined by the upper and lower portions of vertical strips.

3. A container as defined in claim 1, wherein there are at least two clearances in each of one set of opposed walls each disposed between two saddles, and there are at least two saddles on each of the other set of opposed walls each disposed between two clearances.

4. A nesting and stacking container comprising a square bottom, first, second, third and fourth walls projecting upwardly from the edges of said bottom, each of said walls having a plurality of feet spaced from one another along the lower edge portion thereof, each of said walls having a plurality of saddles spaced from one another along the upper edge portion thereof, the saddles of each of said walls being located directly above the feet thereof so that the feet of said container will engage the saddles of a similarly oriented lower container of identical construction and support the same in a stacked relationship, each of said walls having a plurality of spaced clearances laterally offset from the saddles thereof, the width of the clearances of the first and second walls exceeding the width of the feet of the third and fourth walls and the width of the clearances of the third and fourth walls exceeding the width of the feet of the first and second walls, the spacing and lateral placement of the saddles of said third and fourth walls corresponding to the spacing and lateral placement of the clearances of said first and second walls, the spacing and lateral placement of the saddles of said first and second walls corresponding to the spacing and lateral placement of the clearances of said third and fourth walls, whereby when said container is turned with respect to a lower container of identical construction to align the first and second walls thereof respectively with the third and fourth walls of the lower container, it may be lowered into a nested relationship therewith without interference because the feet thereof will enter and pass through the clearances of the lower container, elongated generally horizontal rails along each wall in general horizontal alignment with the saddles thereof, said saddles constituting horizontal extensions of said rails, and downwardly extending rail followers on certain of the feet on each said wall, said rail followers being adapted to engage the rails of a similarly oriented lower container of identical construction to facilitate sliding thereof to a stacked position, said feet, rails and clearances on each wall being of such dimension and location that when said container is being slid to a stacked position on a similarly oriented lower container of identical construction said feet will be supported by said rails and bridge over said clearances.

5. A nesting and stacking container comprising a bottom, first and second walls projecting upwardly from the edges of said bottom, each of said walls having a plurality of feet spaced from one another along the lower edge portion thereof, each of said walls having a plurality of saddles spaced from one another along the upper edge portion thereof, the saddles of each of said walls being located directly above the feet thereof so that the feet of said container will engage the saddles of a similarly oriented, lower container of identical construction and support the same in a stacked relationship, each of said walls having a plurality of spaced clearances laterally offset from the saddles, the width of the clearances of said first wall exceeding the width of the feet of said second wall and the width of the clearances of said second wall exceeding the width of the feet of said first wall, the spacing and lateral placement of the saddles of said second wall corresponding to the spacing and lateral placement of the clearances of said first wall, the spacing and lateral placement of the saddles of said first wall corresponding to the spacing and lateral placement of the clearances of said second wall, whereby when said container is turned with respect to a lower container of identical construction to align the first and second walls thereof respectively with the second and first walls of the lower container it may be lowered into a nested relationship therewith without interference because the feet thereof will enter and pass through the clearances of the lower container, elongated, generally horizontal rails along each wall in general horizontal alignment with the saddles thereof, said saddles constituting horizontal extensions of said rails, and downwardly extending rail followers on certain of the feet on each said wall, said rail followers being adapted to engage the rails of a similarly oriented lower container of identical construction to facilitate sliding thereof to a stacked position, said feet, rails and clearances on each wall being of such dimension and location that when said container is being slid to a stacked position on a similarly oriented lower container of identical construction said feet will be supported by said rails and bridge over said clearances.

* * * * *